US005533683A

United States Patent [19]

Fay et al.

[11] Patent Number: 5,533,683

[45] Date of Patent: Jul. 9, 1996

[54] TISSUE GRINDING SYSTEM

[75] Inventors: John E. Fay; Michael Faulkner, both of Leominster, Mass.

[73] Assignee: Biomedical Polymers, Inc., Leominster, Mass.

[21] Appl. No.: 359,958

[22] Filed: Dec. 20, 1994

Related U.S. Application Data

[63] Continuation of Ser. No. 165,098, Dec. 9, 1993, abandoned.

[51] Int. Cl.[6] ..... B02C 1/00; B02C 19/08

[52] U.S. Cl. ..... 241/169; 241/169.1; 241/169.2; 241/199.11; 241/199.12

[58] Field of Search ..... 241/168, 169, 241/169.1, 169.2, 199.9, 199.11, 199.12

[56] References Cited

U.S. PATENT DOCUMENTS

| | | | |
|---|---|---|---|
| 2,161,998 | 6/1939 | Chott | 241/169.2 X |
| 2,484,391 | 10/1949 | Treiss, Jr. | 241/169.2 X |
| 3,773,468 | 11/1973 | Hubbard et al. | 241/169.2 X |
| 3,895,548 | 7/1975 | Sauve | 241/169.2 X |
| 4,212,430 | 7/1980 | Dale et al. | 241/169.2 X |
| 4,366,930 | 1/1983 | Trombetti, Jr. | 241/169.1 X |
| 4,505,433 | 3/1985 | Selenke | 241/169.1 X |
| 4,967,971 | 11/1990 | Smith | 241/169.2 X |

*Primary Examiner*—Timothy V. Eley
*Attorney, Agent, or Firm*—Iandiorio & Teska

[57] ABSTRACT

A tissue grinding system includes a container having an open top portion, a bottom portion having a first grinding surface on an interior surface, and a wall portion interconnecting the top portion and bottom portion defining a hollow interior chamber; a grinder receivable in the top portion of the container and having a second grinding surface engageable with the first grinding surface and including an actuator portion extending beyond the top portion, and a closure device sealingly engaged with the grinder and with the open top portion of the container to seal the chamber.

35 Claims, 4 Drawing Sheets

TISSUE GRINDING SYSTEM

This is a continuation of application Ser. No. 08/165,098, filed Dec. 9, 1993 which is now abandoned.

FIELD OF INVENTION

This invention relates to an improved tissue grinding system.

BACKGROUND OF INVENTION

There is an ever increasing need in medical and microbiology for the collection, processing, testing and examination of clinical tissue. Generally tissue samples were collected in one vessel, then transferred to another for grinding before testing and examination. In one or more of these stages open containers may be used and the specimen may be transferred from one vessel to another. Open vessels, transfers, transporting and handling in general of the specimens create the potential for spillage, and contamination of the specimens as well as contamination of the personnel and environment.

One recent attempt to provide a more dedicated tissue grinder device used a narrow cylindrical tube with a conical internal first grinding surface that received a closely size-conforming cylindrical grinder with a conical external second grinding surface which engages the first. The grinder is only marginally smaller than the tube so that even a slight excess of specimen is apt to be compressed and squirt out contaminating people and things in the area. To mitigate the danger a plastic bag is applied to the grinder with a rubber band or "O" ring so that it shrouds the seam between the grinder and tube. This still requires the user to reach under the shroud and grip the possibly contaminated tube in order to separate it from the grinder. Further, the conical bottom on the tube makes it incapable of standing on its own, requiring one hand to hold and stabilize it at all times and increasing the potential for a hazardous spill. Such devices are open systems which increase the risk of contamination of the sample specimens on the one hand and the equipment and personnel on the other. They are also complicated, require a number of steps to complete assembly before use, and must be used in conjunction with some sort of ancillary stand since these bases are generally conical.

SUMMARY OF INVENTION

It is therefore an object of this invention to provide an improved tissue grinding system.

It is a further object invention to provide such an improved tissue grinding system which is a closed system, totally sealed between the container and grinder.

It is a further object invention to provide such an improved tissue grinding system which enables a single container to be used for collection, grinding, transporting, testing and examination.

It is a further object invention to provide such an improved tissue grinding system which prevents leakage, loss and squirting of excess specimen.

It is a further object invention to provide such an improved tissue grinding system which provides an enlarged overflow volume to accommodate excess specimen without overflow or leakage.

It is a further object invention to provide such an improved tissue grinding system which stands alone stably and safely.

It is a further object invention to provide such an improved tissue grinding system which reduces chance of contamination of the sample and of equipment and personnel.

It is a further object invention to provide such an improved tissue grinding system which is easy and quick to use without the need for assembly of sub-components.

The invention results from the realization that a safe, sealed, stand-alone closed tissue grinding system which avoids loss and leakage can be achieved by using a grinder and container having engageable grinding surfaces which are engaged by means of a closure device that seals to both the grinder and container to form a leak-proof chamber, and which further provides an enlarged overflow volume to accommodate excess specimen and provides a stand for independently supporting the container.

This invention features a tissue grinding system including a container having an open top portion, a bottom portion having all interior first grinding surface on an interior surface and a wall portion interconnecting the top portion and bottom portion for defining a hollow interior chamber. There is a grinder receivable in the top portion of the container and having a second grinding surface engageable with the first grinding surface and including all actuator portion extending beyond the top portion. A closure device sealingly engages with the grinder and with the open top portion of the container to seal the chamber.

In a preferred embodiment the container may include a stand portion for independently supporting the container. The grinder may be substantially narrower than the container to form an overflow volume in the chamber. The bottom portion may include a generally conical section and the first grinding surface may be on that conical section. The second grinding surface also may be generally conical in shape. The closure means may include a cap threadably engageable with the container. The cap may have a hole for frictionally, sealingly, engaging the grinder. The container may generally have the shape of an elongate cylinder, and so may the grinder. The grinder may include at least one recess for forming an overflow volume in the chamber. The grinder may include removable grinding tip. The grinder may include a pair of axially spaced flanges for sealingly engaging the closure device. Those flanges may be spaced apart by the width of the closure device which they engage or by a space greater than that for enabling sealing of the grinder to the container while accommodating axial displacement of the grinder.

DISCLOSURE OF PREFERRED EMBODIMENT

Other objects, features and advantages will occur to those skilled in the art from the following description of a preferred embodiment and the accompanying drawings, in which.

Figures 3, 4, 5:
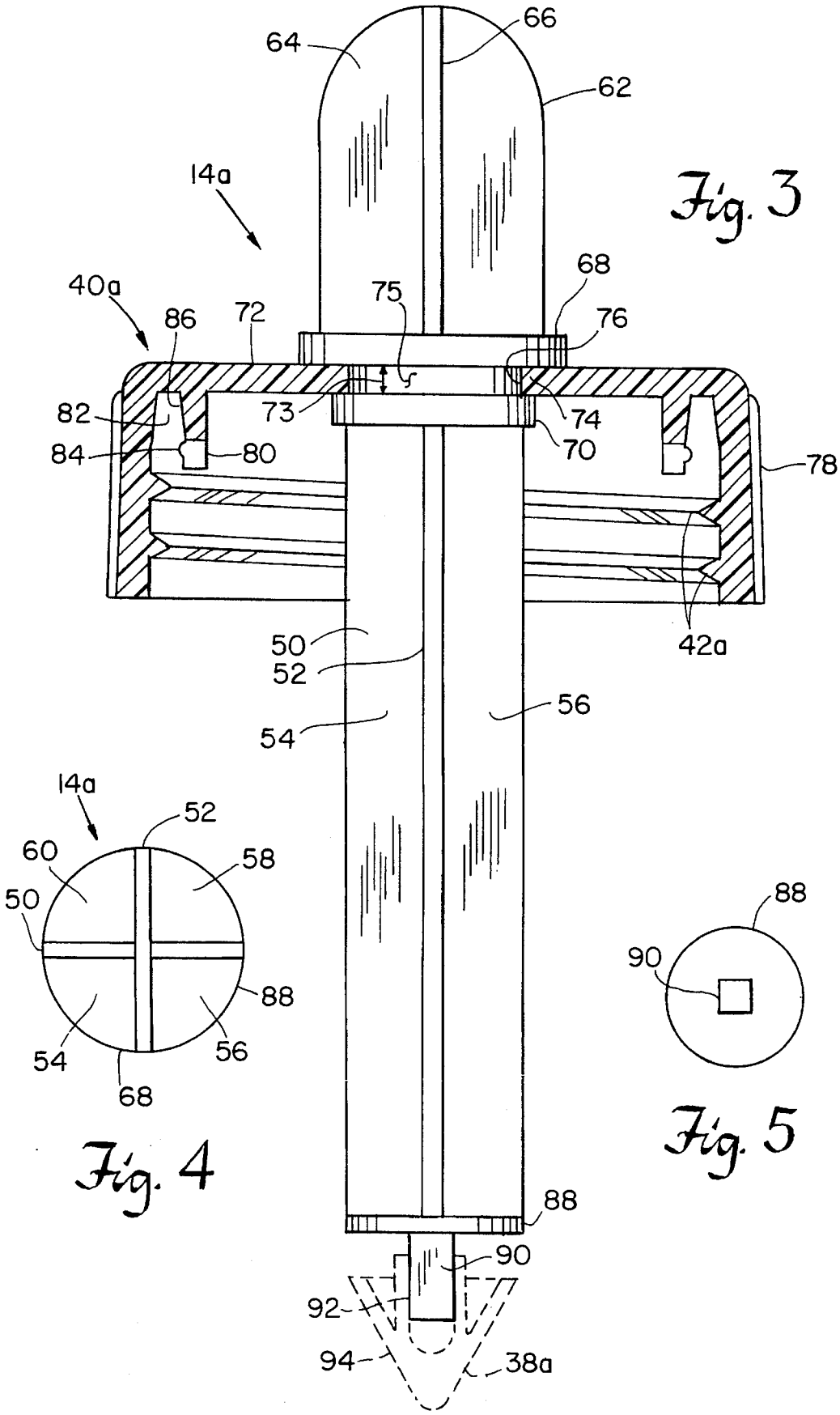
FIG. 3 is a cross-sectional, elevational view of a closure device or cap and a grinder with a replaceable grinder tip according to an alternative embodiment of the invention.
FIG. 4 is a top plan view of FIG. 3.
FIG. 5 is a bottom plan view of FIG. 3.

The tissue grinding system according to this invention may be accomplished using replaceable grinder tip as shown in FIG. 3; a container having an open top portion and a closed bottom portion having on an interior surface a first grinding surface. There is a wall portion interconnecting the top portion and the bottom to define a hollow chamber. The grinder is receivable in the top portion of the container and has a second grinding surface which is engageable with the first grinding surface. The grinder includes an actuator portion which extends beyond the top portion which can be gripped and pressed or twirled to grind the tissue between the grinding surface. A closure device sealingly engages with the grinder and with the open top portion of the container to seal the chamber. The container and the grinder may be made of plastic or glass, and the closure means may be a cap made of plastic or other similar material which may be snapped-fitted, threaded, or otherwise scalingly engaged with the top of the container. There is a hole through the middle of the cap which engages the grinder in a frictional or interference fit to form a seal between the cap and the grinder so that the chamber inside the container is safely sealed. The tip of the grinder may have a conical shape with the grinding surface on it, and there may be a conical recession in the bottom of the container which also contains a grinding surface for mating with the grinding surface on the grinder. Although conical surfaces are convenient, they are not a necessary limitation of the invention. An additional feature of the invention is the use of a stand or a skirt that extends down beyond the conical or other shaped tip at the bottom of the container to provide a stable and secure stand for the container so that it can stand alone in a vertical orientation. The grinder and the container are both generally elongate cylindrical shapes and the grinder typically has a much smaller radius than the container so that an enlarged overflow area is formed in the chamber between the grinder and the container to accommodate any excess specimen without causing the specimen to be forced against the seals imposed by the cap with the grinder and container.

Figure 1:
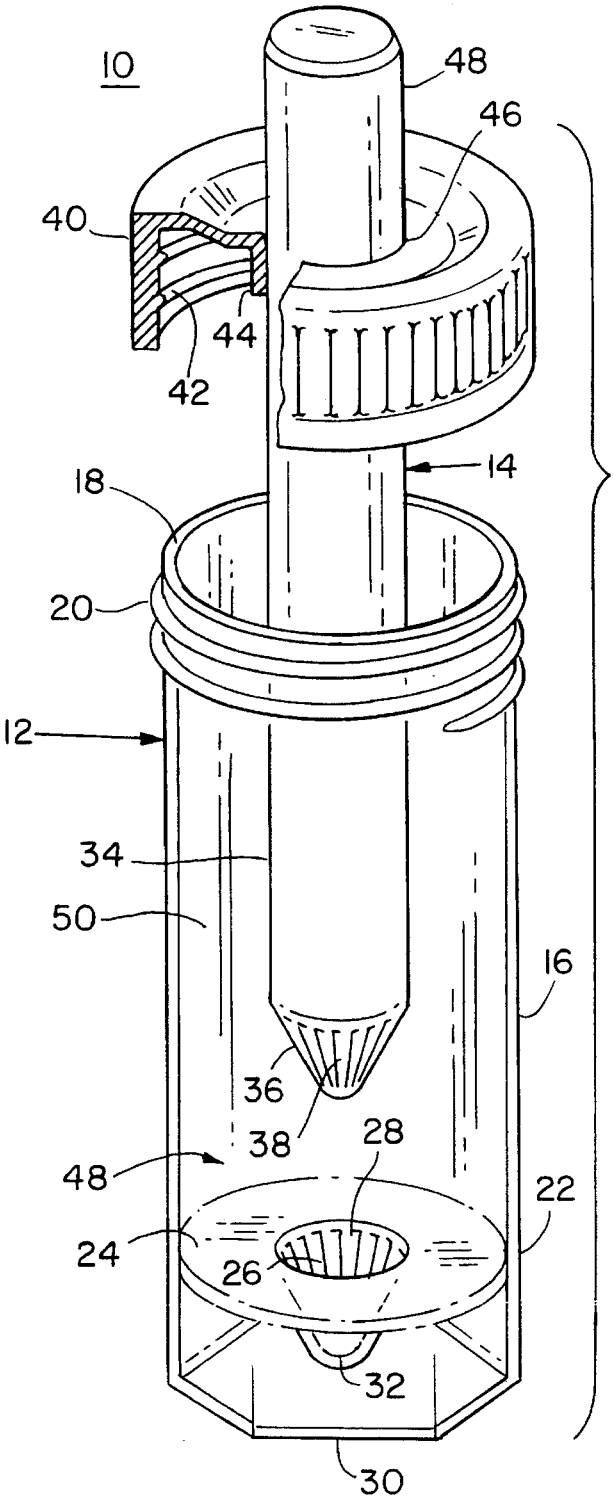
FIG. 1 is a three-dimensional view of a tissue grinding system according to this invention with the grinder partially installed in the container.

There is shown in FIG. 1 a tissue grinding system 10 according to this invention which includes a container 12 and grinder 14. Container 12 includes a plastic generally transparent cylindrical body 16 with all open top 18 having threads 20. The base 22 of container 12 includes a shoulder portion 24 and a conical depression 26, the internal surface of which includes a grinding surface 28. A skirt stand 30 extends from coextensively with wall 16 beyond the apex 32 of cone 26. Stand 30 therefore acts as an independent support so that container 12 can stand alone in the vertical orientation as shown. Grinder 14 may also be a plastic or glass elongate cylindrical body having a wall 34 terminating in a conical tip 36 which contains grinding surface 38 that mates with grinding surface 28 in conical recess 26. Grinder 14 is long enough to extend above opening 18 of container 12 when grinder 14 is fully seated with grinding surface 38 mating with grinding surface 26 to allow the grinder to be pressed and/or twirled to effect the grinding action. In this position a closure device such as cap 40 which contains internal threads 42 is engaged with threads 20 in the top of container 12. Wall 34 of grinder 14 is frictionally tightly gripped by the flexible plastic wall 44 which forms hole 46 in cap 40 so that in the installed position cap 40 is sealed to container 12 and is sealed to grinder 14 to provide a complete safely sealed chamber 48 in container 12 while permitting handle 48 of grinder 14 to be twirled or spun to effect the grinding action between surfaces 26 and 38. In addition, the significant difference in the width of container 12 and grinder 14, that is, the fact that grinder 14 is substantially narrower than container 12, provides an enlarged overflow volume 50 in the annular area between grinder 14 and container 12 so that any excess specimen has ample room to locate without being forced or pressured against the seals made by cap 40 with grinder 14 in container 12.

Figure 2:
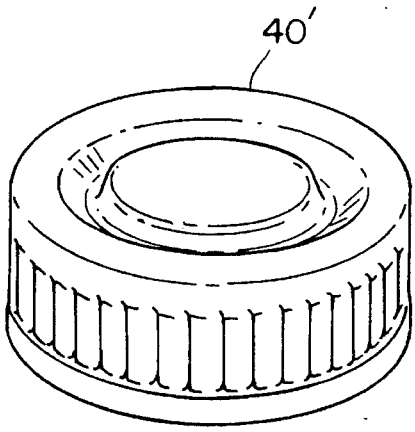
FIG. 2 is a perspective view of a conventional cap for sealing the container of FIG. 1 in the absence of the grinder.

At any time in the use of container 12 before or after grinder 14 is installed, container 12 may be used or transported in a safe, sealed condition by the employment of a standard cap 40', FIG. 2, which contains threads similar to threads 42 on cap 40 for engaging the threads 20 on container 12.

The excess volume produced by using a grinder 14 smaller than the container 12 can also be achieved by using a grinder **14*a*, FIG. 3, composed of two perpendicular planar walls 50, 52, FIG. 4, which create four longitudinal recesses 54, 56, 58, 60. The handle 62 of grinder 14*a* may also be formed of two perpendicular planar walls 64, 66. Two annular flanges 68, 70 are spaced apart the width of the top 72 of cap 40*a* to create a gap 73 for sealingly engaging the edge 74 of hole 76 with surface 75 of grinder 14*a***.

Cap **40*a* has a gripping surface 78 and an internal depending wall 80 for forming peripheral channel 82 to receive the top of a container 12. Wall 80 has an external bead 84 and the top of a channel 82 is tapered 86** to provide improved sealing.

Figure 6:
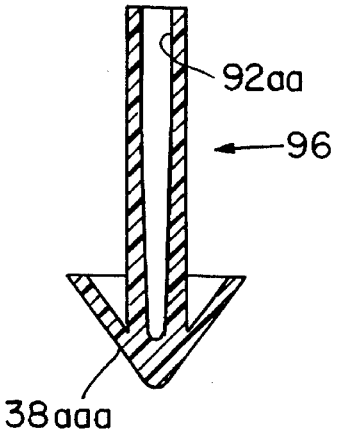
FIG. 6 is an elevational, cross-sectional view of an alternative form of replaceable grinder tip as shown in phantom in FIG. 3.
Figure 7:
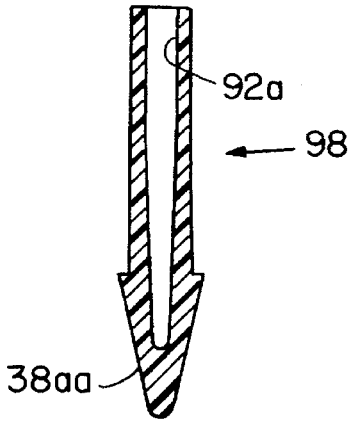
FIG. 7 is an elevational, cross-sectional view of another alternative form of replaceable grinder tip as shown in FIG. 3.

The lower end of grinder **14*a* includes circular plate 88 and a square stub 90 which is force fit to a similar square but tapered hole 92 in replaceable grinder tip 94. Other typical replaceable grinder tips 96, FIG. 6, 98, FIG. 7, can be varied as to their length to accommodate different relative lengths of grinders and tables, as to their shape to accommodate different shaped recesses 26**, and as to their surfaces to accommodate different samples/grinding results. The square stub and hole are used to ensure that the grinder tip and the remainder of the grinder do not rotate relative to each other.

Figure 8:
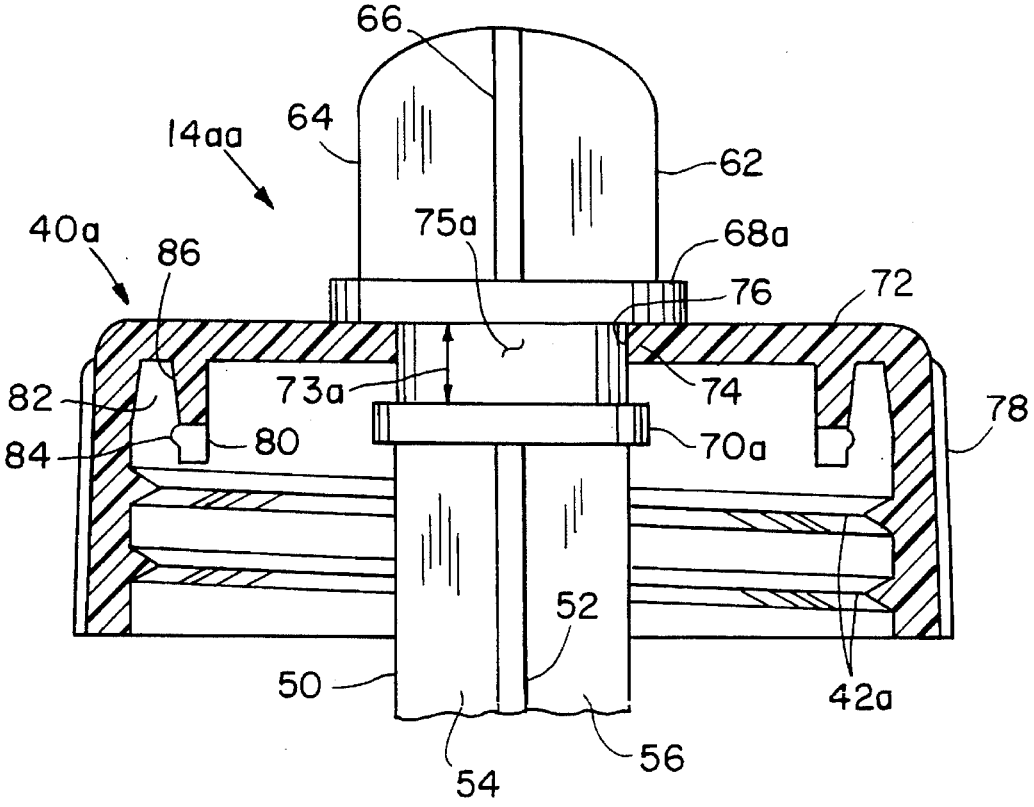
FIG. 8 is a cross-sectional, elevational view of a cap as shown in FIG. 3 with an alternative form of grinder which accommodates axial adjustment of the grinder.
Figure 9:
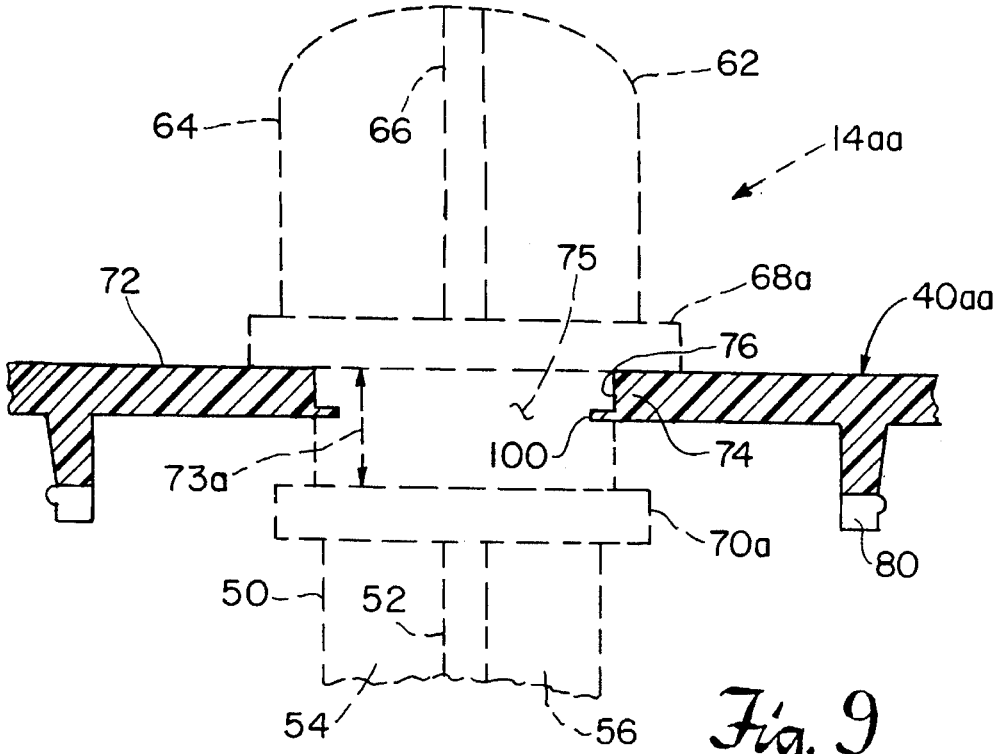
FIG. 9 is a cross-sectional, elevational view of a cap as shown in FIG. 3 with an alternative form of seal that accommodates axial motion of the grinder (shown in phantom) of FIG. 8.
Figure 10:
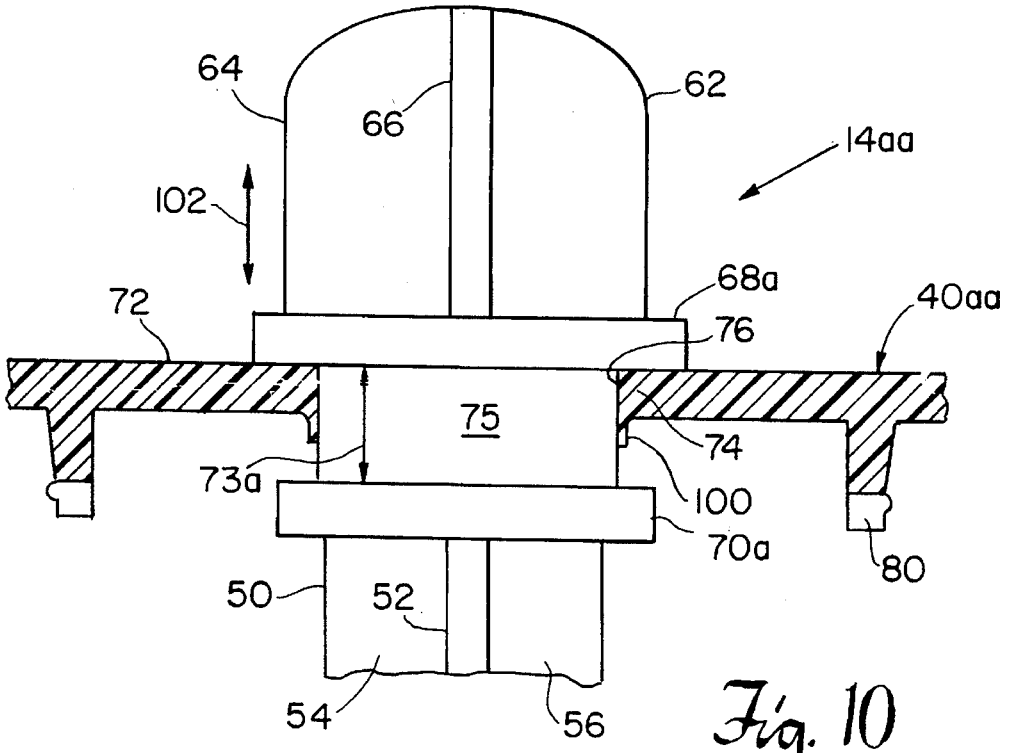
FIG. 10 is a cross-sectional, elevational view of the cap as shown in FIG. 8 with the seal of FIG. 9 actually engaging the grinder.

If axial accommodation is needed between the grinder and container such as to allow for slight differences in sizes or to allow for sealing of the cap to the container before pressing the grinder surface into a sample then the gap 73 can be axially enlarged as at gap **73*a*, FIG. 8, of grinder 14*aa*. To ensure a good seal between grinder 14*aa* and cap 40*aa*, FIG. 9, an annular sealing flange 100 is provided. Then when grinder 14*aa* is pushed through hole 76 and flange 70*a* snaps past edge 74, sealing flange 100 is pressed outwardly, FIG. 10, to create a form of wiper cuff that seals against surface 75*a* even during axial motion 102 of grinder 14*aa***.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A tissue grinding system comprising:

a container having an open top portion, a bottom portion having an interior first grinding surface and a wall portion interconnecting said top portion and bottom portion for defining a hollow interior collection chamber;

a grinder receivable in said top portion of said container and having a second grinding surface engageable with said first grinding surface including an actuator portion extending beyond said top portion, said grinder having an X-shaped cross-section providing an enlarged overflow volume within said collection chamber to accommodate excess specimen without overflow or leakage; and a closure device sealingly engageable with said grinder and with said open top portion of said container to seal said collection chamber, said collection chamber located between said first grinding surface and said top portion;

such that the combination of said collection chamber, said grinder and said closure device act as a tissue grinding system.

2. The tissue grinding system of claim 1 in which said container includes a stand portion for independently supporting said container.

3. The tissue grinding system of claim 1 in which said bottom portion includes a conical section and said first grinding surface is on said conical section.

4. The tissue grinding system of claim 3 in which said second grinding surface is conical in shape.

5. The tissue grinding system of claim 1 in which said closure device includes a cap threadably engageable with said container.

6. The tissue grinding system of claim 1 in which said closure device includes a cap having a hole, said hole for receiving and frictionally and sealingly engaging said grinder with respect to said cap.

7. The tissue grinding system of claim 1 in which said container is an elongate cylinder.

8. The tissue grinding system of claim 1 in which said grinder includes a removable grinding tip.

9. The tissue grinding system of claim 6 in which said grinder includes a pair of axially spaced flanges for sealingly engaging said grinder with respect to said cap.

10. The tissue grinding system of claim 9 in which said flanges are spaced apart by the thickness of the portion of the closure device with which they engage.

11. The tissue grinding system of claim 9 in which said flanges are spaced apart greater than the thickness of the portion of the closure device with which they engage, for enabling sealing of said grinder to said cap while accommodating axial displacement of said grinder.

12. A tissue grinding system comprising:

a container having an open top portion, a bottom portion having an interior first grinding surface and a wall portion interconnecting said top portion and bottom portion for defining a hollow interior collection chamber;

a grinder receivable in said top portion of said container and having a second grinding surface engageable with said first grinding surface including an actuator portion extending beyond said top portion, said grinder having a size with displaces a volume within said collection chamber which is substantially less than the volume within said collection chamber; and a closure device sealingly engageable with said grinder and with said open top portion of said container to seal said collection chamber, said collection chamber located between said first grinding surface and said top portion;

wherein said closure device includes a cap having a hole, said hole receiving and frictionally and sealingly engaging said grinder with respect to said cap; and wherein said grinder includes a pair of axially spaced flanges for sealingly engaging said grinder with respect to said cap;

such that the combination of said collection chamber, said grinder and said closure device act as a tissue grinding system.

13. The tissue grinding system of claim 12 in which said bottom portion includes a conical section and said first grinding surface is on said conical section.

14. The tissue grinding system of claim 13 in which said second grinding surface is conical in shape.

15. The tissue grinding system of claim 12 in which said cap is threadably engageable with said container.

16. The tissue grinding system of claim 12 in which said container is an elongate cylinder.

17. The tissue grinding system of claim 12 in which said grinder includes a removable grinding tip.

18. The tissue grinding system of claim 12 in which said flanges are spaced apart by the thickness of the portion of the closure device with which they engage.

19. The tissue grinding system of claim 12 in which said flanges are spaced apart greater than the thickness of the portion of the closure device with which they engage, for enabling sealing of said grinder to said cap while accommodating axial displacement of said grinder.

20. A tissue grinding system comprising:

a container having an open top portion, a bottom portion having an interior first grinding surface, and a wall portion interconnecting said top portion and bottom portion for defining a hollow interior collection chamber;

a grinder receivable in said top portion of said container, said grinder including an actuator portion extending beyond said top portion and a removable tip having a second grinding surface engageable with said first grinding surface and a junction between said removable tip and said actuator portion, said junction including a male/female connection for connecting said removable tip to said grinder; and a closure device sealingly engaged with said grinder and with said open top portion of said container to seal said collection chamber, said collection chamber located between said first grinding surface and said top portion;

wherein said closure device includes a cap having a hole, said hole receiving and frictionally and sealingly engaging said grinder with respect to said cap; and wherein said grinder includes a pair of axially spaced flanges for sealingly engaging said grinder with respect to said cap;

such that the combination of said collection chamber, said grinder and said closure device act as a tissue grinding system.

21. The tissue grinding system of claim 20 in which said bottom portion includes a conical section and said first grinding surface is on said conical section.

22. The tissue grinding system of claim 21 in which said second grinding surface is conical in shape.

23. The tissue grinding system of claim 20 in which said cap is threadably engageable with said container.

24. The tissue grinding system of claim 20 in which said container is an elongate cylinder.

25. The tissue grinding system of claim 20 in which said grinder includes at least one recess for forming an overflow volume in said chamber.

26. The tissue grinding system of claim 20 in which said flanges are spaced apart by the thickness of the portion of the closure device with which they engage.

27. The tissue grinding system of claim 20 in which said flanges are spaced apart greater than the thickness of the portion of the closure device with which they engage, for enabling sealing of said grinder to said cap while accommodating axial displacement of said grinder.

28. The tissue grinding system of claim 20, said male/female connection including a square stub in an interference fit with a square hole.

29. The tissue grinding system of claim 20 in which said removable tip can be interchanged with different size tips to accommodate different size containers.

30. A tissue grinding system comprising:

a container having an open top portion, a bottom portion having an interior first grinding surface and a wall portion interconnecting said top portion and bottom portion for defining a hollow interior collection chamber;

a grinder receivable in said top portion of said container and having a second grinding surface engageable with said first grinding surface including an actuator portion extending beyond said top portion, said grinder having an X-shaped cross-section providing an enlarged overflow volume within said collection chamber to accommodate excess specimen without overflow or leakage;

said grinder having a size which displaces a volume within said collection chamber which is substantially less than the volume of said collection chamber;

a closure device sealingly engageable with said grinder and with said open top portion of said container to seal said collection chamber, said collection chamber located between said first grinding surface and said top portion;

such that the combination of said collection chamber, said grinder, and said closure device act as a tissue grinding system.

31. A tissue grinding system comprising:

a container having an open top portion, a bottom portion having an interior first grinding surface and a wall portion interconnecting said top portion and bottom portion for defining a hollow interior collection chamber;

a grinder receivable in said top portion of said container and having a second grinding surface engageable with said first grinding surface including an actuator portion extending beyond said top portion; and a closure device sealingly engaged with said grinder and with said open top portion of said container to seal said collection chamber, said collection chamber located between said first grinding surface and said top portion, said closure device including an annular sealing flange forming a wiper cuff for sealing against the grinder during axial motion of the grinder;

such that the combination of said collection chamber, said grinder and said closure device act as a tissue grinding system.

32. A tissue grinding system comprising:

a container having an open top portion, a bottom portion having an interior first grinding surface, and a wall portion interconnecting said top portion and bottom portion for defining a hollow interior collection chamber;

a grinder receivable in said top portion of said container and having a second grinding surface engageable with said first grinding surface including an actuator portion extending beyond said top portion, said grinder including a pair of axially spaced flanges for sealingly engaging said closure device; and a closure device sealingly engageable with said grinder and with said open top portion of said container to seal said collection chamber, said collection chamber located between said first grinding surface and said top portion;

such that the combination of said collection chamber, said grinder and said closure device act as a tissue grinding system.

33. The tissue grinding system of claim 32 in which said flanges are spaced apart greater than the thickness of the portion of the closure device with which they engage, for enabling sealing of said grinder to said container while accommodating axial displacement of said grinder.

34. The tissue grinding system of claim 32 in which said flanges are spaced apart by the thickness of the portion of the closure device with which they engage.

35. A tissue grinding system comprising:

a container having an open top portion, a bottom portion having an interior first grinding surface, and a wall portion interconnecting said top portion and bottom portion for defining a hollow interior collection chamber;

a grinder receivable in said top portion of said container said grinder including an actuator portion extending beyond said top portion, a removable tip having a second grinding surface engageable with said first grinding surface and a junction between said removable tip and said actuator portion, said junction including a male/female connection for connecting said removable tip to said grinder and an X-shaped cross-section providing an enlarged overflow volume within said collection chamber to accommodate excess specimen without overflow or leakage;

said grinder having a size which displaces a volume within said collection chamber which is substantially less than the volume of said collection chamber; and a closure device sealingly engaged with said grinder and with said open top portion of said container to seal said collection chamber, said collection chamber located between said first grinding surface and said top portion, said closure device including an annular sealing flange forming a wiper cuff for sealing against the grinder during axial motion of the grinder;

such that the combination of said collection chamber, said grinder and said closure device act as a tissue grinding system.

* * * * *